US007849627B2

(12) United States Patent
Wygant

(10) Patent No.: US 7,849,627 B2
(45) Date of Patent: Dec. 14, 2010

(54) FOAM PROJECTILE

(75) Inventor: Steven J. Wygant, Syracuse, IN (US)

(73) Assignee: Blackpoint Engineering, LLC, Goshen, IN (US)

( * ) Notice: Subject to any disclaimer, the term of this patent is extended or adjusted under 35 U.S.C. 154(b) by 277 days.

(21) Appl. No.: 12/167,304

(22) Filed: Jul. 3, 2008

(65) Prior Publication Data

US 2009/0050127 A1 Feb. 26, 2009

Related U.S. Application Data

(60) Provisional application No. 60/948,049, filed on Jul. 5, 2007.

(51) Int. Cl.
*F41A 27/00* (2006.01)

(52) U.S. Cl. ..... 42/75.03; 124/56; 124/63; 446/429; 446/430; 446/473; 446/267

(58) Field of Classification Search ..... 124/56, 124/63; 446/429, 430, 473, 267
See application file for complete search history.

(56) References Cited

U.S. PATENT DOCUMENTS 3,077,876 A * 2/1963 Richter ..... 124/65
3,649,020 A * 3/1972 Hall ..... 473/569
3,952,662 A * 4/1976 Greenlees ..... 102/400
4,076,006 A * 2/1978 Breslow et al. ..... 124/64
4,084,820 A * 4/1978 Olson, Jr. ..... 473/511
4,134,228 A * 1/1979 Ortiz ..... 446/225
4,438,587 A * 3/1984 Marino ..... 446/202
5,415,153 A * 5/1995 Johnson et al. ..... 124/63
5,653,216 A * 8/1997 Johnson ..... 124/69
6,347,623 B1 * 2/2002 Kownacki et al. ..... 124/56
6,568,985 B1 * 5/2003 Binkley ..... 446/176
6,695,676 B2 * 2/2004 Blake ..... 446/473
6,808,436 B1 * 10/2004 Siu ..... 446/231
7,526,998 B2 * 5/2009 Vasel et al. ..... 102/502
2004/0031473 A1 * 2/2004 Fireman et al. ..... 124/16
2005/0183708 A1 * 8/2005 Eddins et al. ..... 124/59
2007/0099541 A1 * 5/2007 Yu et al. ..... 446/429
2008/0127958 A1 * 6/2008 Mullin ..... 124/56
2009/0266262 A1 * 10/2009 Vasel et al. ..... 102/370

* cited by examiner

*Primary Examiner*—Troy Chambers
*Assistant Examiner*—Samir Abdosh
(74) *Attorney, Agent, or Firm*—Taylor IP, P.C.

(57) ABSTRACT

A combat game weapon system includes a pneumatic launcher and an elastic projectile. The pneumatic launcher includes a barrel. The barrel includes a distal end and a bore with an inside diameter. The elastic projectile is configured for being expelled from the distal end of the barrel. The elastic projectile includes a cavity configured for expanding when the cavity receives a propellant from the pneumatic launcher and thereby for causing the elastic projectile to sealingly engage the inside diameter.

18 Claims, 6 Drawing Sheets

FOAM PROJECTILE

CROSS REFERENCE TO RELATED APPLICATIONS

This is a non-provisional application based upon U.S. provisional patent application Ser. No. 60/948,049, entitled "FOAM PROJECTILE", filed Jul. 5, 2007, which is incorporated herein by reference.

BACKGROUND OF THE INVENTION

1. Field of the Invention

The present invention relates to combat game weapon systems, and, more particularly, to projectiles of combat game weapon systems.

2. Description of the Related Art

Simulated weapon systems typically include a pneumatic shooting device and a projectile. The system can be used as a non-lethal deterrent in law enforcement, as a simulated weapon in war games, and as systems in what is commonly referred to as "paintball". In addition to the paintball gun, simulated launchers, hand grenades, exploding land mines, rockets, and other combat game weapons have been employed in mock war games.

A foam projectile is known which does not have a hollow core but does have a rigid pin core that is used to stiffen the tail section of the projectile. The pin usually has a molded head that keeps it in position and to reduce the effect of impact. A problem with this construct is that it allows high pressure gas to blow by and between the inner diameter of the barrel of a launcher and the outer perimeter of the projectile.

Another foam projectile is known which uses a stiffening tube that fills the periphery of a cavity in the projectile. The stiffening tube is also capped with an end cap at the leading end of the cavity. A problem with this construct is that the stiffening tube and the end cap are rigid and do not allow the gas flow in the cavity to expand the diameter of the foam projectile.

What is needed in the art is a projectile with a cavity which expands radially upon receiving compressed gas, thereby causing the outer surface of at least a portion of the projectile to engage in a sealing manner the inner diameter of the barrel of the launcher so as to increase the flight distance of the projectile.

SUMMARY OF THE INVENTION

The present invention provides a projectile with a cavity which expands radially upon receiving compressed gas, thereby causing the outer surface of at least a portion of the projectile to engage in a sealing manner the inner diameter of the barrel of the launcher so as to increase the flight distance of the projectile.

The invention in one form is directed to a combat game weapon system including a pneumatic launcher and an elastic projectile. The pneumatic launcher includes a barrel, the barrel including a distal end and a bore with an inside diameter. The elastic projectile is configured for being expelled from the distal end of the barrel. The elastic projectile includes a cavity configured for expanding when the cavity receives a propellant from the pneumatic launcher and thereby for causing the elastic projectile to sealingly engage the inside diameter.

The invention in another form is directed to a combat game projectile for a combat game weapon system including a pneumatic launcher including a barrel having a distal end and a bore with an inside diameter. The combat game projectile includes an elastic projectile configured for being expelled from the distal end of the barrel of the pneumatic launcher. The elastic projectile includes a cavity configured for expanding when the cavity receives a propellant from the pneumatic launcher and thereby for causing the elastic projectile to sealingly engage the inside diameter.

The invention in yet another form is directed to a method of operating a combat game weapon system including the steps of: providing a pneumatic launcher including a barrel, the barrel having a distal end and a bore with an inside diameter; loading the pneumatic launcher with an elastic projectile including a cavity; receiving in the cavity a propellant from the pneumatic launcher; expanding the cavity, when the cavity receives the propellant from the pneumatic launcher, and thereby causing the elastic projectile to sealingly engage the inside diameter; and expelling the elastic projectile from the distal end of the barrel.

An advantage of the present invention is that it provides a simple foam rocket without rigid parts added thereto.

Another advantage is that it provides a simple foam rocket with an elastic cavity and main body.

Yet another advantage is that an outer surface of the main body can sealingly engage the inner diameter of the launcher when the elastic cavity receives a propellant (i.e., compressed gas) from the launcher.

Yet another advantage is that the foam rocket can fly a greater distance.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
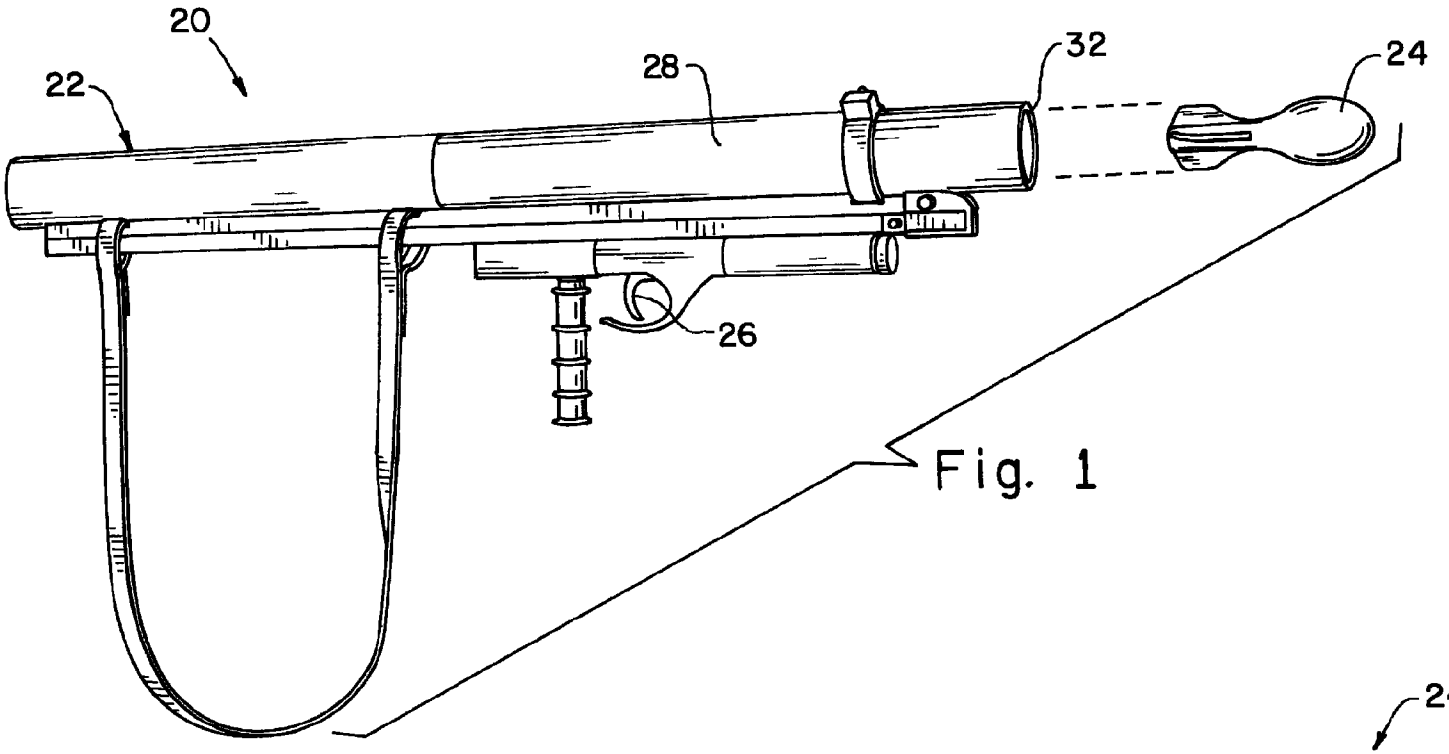
FIG. 1 is an exploded, perspective view of an embodiment of the combat game weapon system of the present invention, the pneumatic launcher shown as a stand-alone device (not mounted under a paintball gun), the projectile exploded from the launcher.

Referring now to the drawings, and more particularly to FIGS. 1-4, there is shown a first embodiment of a combat game weapon system 20 which generally includes a pneumatic launcher 22 and an elastic projectile 24. Projectile 24 is loaded into launcher 22 and expelled therefrom upon squeezing a trigger 26. Combat game weapon system 20 (as well as systems 120, 220, and 320, below) has application to, but is not necessarily limited to, paintball games, although projectile 24 of system 20 may or may not itself carry a paintball to be exploded when projectile 24 strikes a target after having been launched by launcher 22.

Launcher 22 includes trigger 26 and a barrel 28. Barrel 28 includes a proximal end 30 (a breech end), a distal end 32 (a muzzle end), and a bore 33 having an inside diameter 34. Inside diameter 34 is a structure which is the inside surface of barrel 28 along bore 33 (inside diameter can also correspond to a dimension as well when used in that sense). In an informal sense, launcher 22 can be thought of as a "grenade launcher." In FIG. 1, launcher 22 is shown as a stand-alone device in that launcher 22 is not connected to the barrel of a gun. By way of an example, launcher can be a JCS JET CITY SPECIALTIES® paintball product, such as the MKX™ launcher by Blackpoint Engineering, LLC. Upon squeezing trigger 26, launcher 22 emits a propellant 36 in order to push and expel projectile 24 from barrel 28. Using propellant 36, launcher 22 can, for example, launch a foam projectile 24 (i.e., a foam rocket) more than 100 yards (i.e., 150 yards) with a 120 mile per hour muzzle velocity (180 feet per second maximum muzzle velocity). Launcher 22 can use standard paintball air tanks or a 12 gram $CO_2$ (carbon dioxide) adapter. Launcher 22 is configured such that projectile 24 can be breech loaded, the breech being opened by pushing a button (projectile 24 in FIG. 1 is breech loaded in launcher 22). Launcher 22 can have an aircraft aluminum construction.

FIGS. 5-10 show another embodiment of the combat game weapon system, having a reference number 120. System 120 is identical to system 20 except that an alternative form of pneumatic launcher—launcher 122—is used (thus, system 120 also uses projectile 24). Launcher 122 is of an M203 style grenade launcher in which launcher 122 is mounted under the barrel of a gun. In this variant of the pneumatic launcher, projectile 24 is loaded into the muzzle end of launcher 122. All reference numbers to launcher 122 are the same as those references to launcher 22, except for reference number 122. The principle of operation of the present invention remains the same whether launcher 22 or launcher 122 is used. FIGS. 5-10 show barrel 28 of launcher 122 and projectile 24 in cross-section taken along line 4-4 in FIG. 3 relative to projectile 24 and thus along the same line relative to barrel 28 when projectile 24 is loaded in barrel 28 (which corresponds to taking a section line through the top dead center position (or 12 o'clock position) of barrel 28 and the bottom dead center (or 6 o'clock position) of barrel 28). FIGS. 9-13 show barrel 28 of the pneumatic launcher 122. In FIGS. 5-13, it is understood that launcher 22 could be used in place of launcher 122 to launch the projectile in accordance with the present invention.

Propellant 36 is a compressed gas. The compressed gas 36 can be a high pressure gas. More specifically, propellant 36 can be $CO_2$ or compressed air (otherwise referred to as high pressure air). Propellant 36 is shown in the drawings by virtue of its flow after having been injected into bore 33, and thus propellant 36 is shown as arrows. Stated another way, reference character 36 in the drawings corresponds to both the propellant itself and to the flow direction of the propellant.

Figure 11:
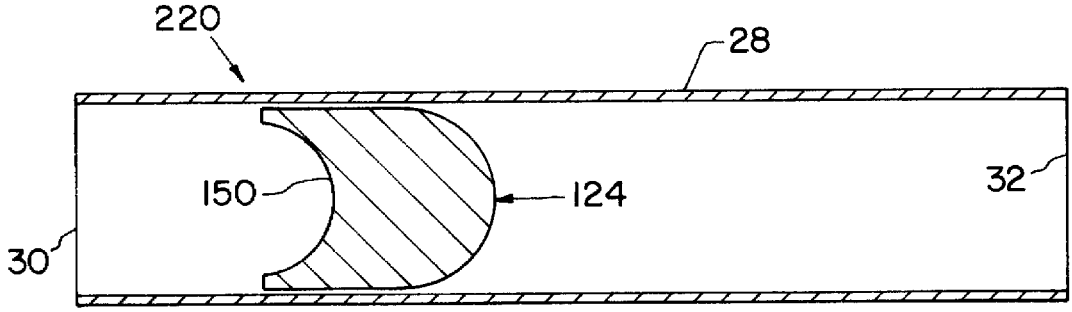
FIG. 11 is a fragmentary, cross-sectional view of yet another embodiment of the combat game weapon system of the present invention.
Figure 12:
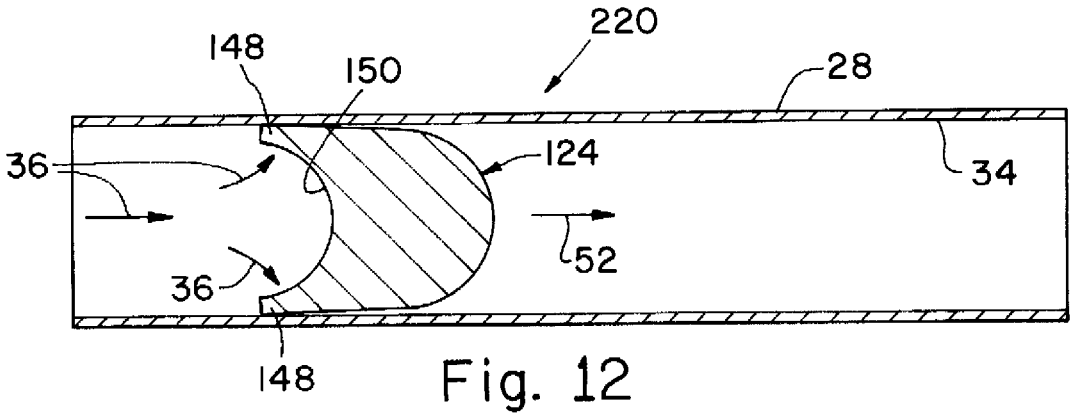
FIG. 12 is a cross-sectional view of the combat game weapon system of FIG. 11.
Figure 13:
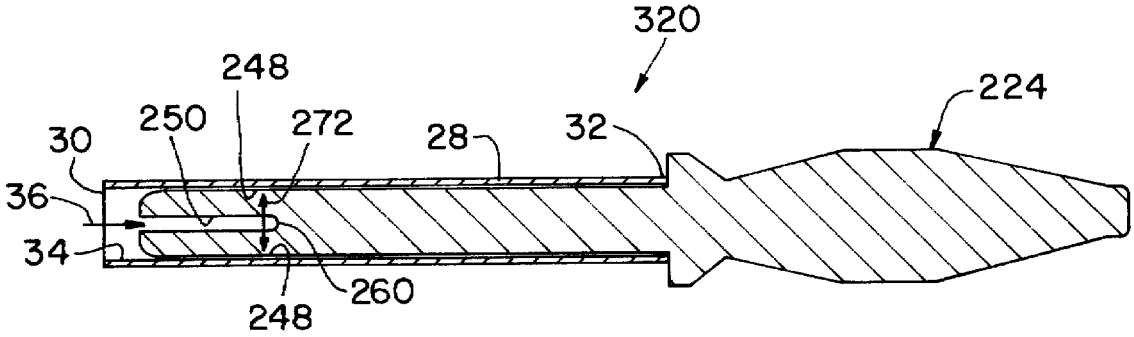
FIG. 13 is fragmentary, cross-sectional view of yet another embodiment of the combat game weapon system of the present invention.

Regarding the projectile according to the present invention, one embodiment of the projectile is shown in FIGS. 1-10 as projectile 24. Another embodiment of the projectile according to the present invention is shown in FIGS. 11 and 12 as projectile 124. Yet another embodiment of the projectile according to the present invention is shown in FIG. 13 as projectile 224.

Projectile 24 is elastic and is configured for being expelled from distal end 32 of barrel 28. Projectile 24 is compressible and expandable and can rapidly substantially assume its initial shape following the end of an action of force. As such, projectile can be entirely elastic and thus may not include a rigid element. Projectile 24 has a foam body 37 and thus can be referred to as a foam projectile 24. Projectile 24 can be such that it includes only foam body 37 (which can include a skin and define a cavity 50, as described below), and thus projectile 24 is foam body 37. Foam body 37 is made only of a soft, durable foam. Body 37 is a flexible, elastic, porous foam. Body 37 can be made out of a porous polymeric material, such as a polyurethane foam. For purposes of clarity, the drawings do not show any pores of foam body 37. When forming foam body 37 in a mold, a skinning effect in the mold can be provided such that foam body 37 includes a skin. It is understood that the foam body 37 in FIGS. 1-10 includes the skin. The skin, while not specifically labeled in the drawings, is effectively shown by the solid lines forming the external contour of foam body 37 as well as the solid lines forming the contour of cavity 50. The skin is thin, flexible, and elastic and forms a continuous and uninterrupted surface of foam body 37, the surface being the external surface of body 37 and the surface of cavity 50 (cavity 50 being formed and thus defined by foam body 37). The skin serves, at least in part, to enclose any otherwise exposed pores on the external surface of foam body 37 and on the surface of cavity 50 of foam body 37. The skin of foam body 37 selectively has a predetermined thickness. The skin is made of the same material as foam body 37 and can thus made of a polymeric material, such as polyurethane. Projectile 24 can thus be a monolithic structure. Projectile 24 does not have a hard or rigid pin or tube therein (i.e., a plastic pin or tube).

An example of projectile 24 is the JCS JET CITY SPECIALTIES® F-69™ foam rocket by Blackpoint Engineering, LLC. Further, while FIGS. 1-4 show projectile 24 as having a solid nose (the nose being at leading end 40), the nose could be hollow so as to form a hollow point projectile such that a paintball could be loaded into the hollow nose and be carried by the projectile in order to explode when the projectile impacts a target. An example of such a hollow point projectile is the JCS JET CITY SPECIALTIES® F-69-HP™ foam rocket by Blackpoint Engineering, LLC.

Projectile 24 (and, thus, foam body 37) further includes a longitudinal axis 38, a leading end 40, a trailing end 42, a head portion 44 symmetric about longitudinal axis 38, a fin portion 46 symmetric about longitudinal axis 38 and connected to head portion 44 in a seamless manner, an outer surface 48, and a cavity 50. While not specifically labeled in the drawings, a neck portion of projectile forms the bridge or transition between head portion 44 and fin portion 46. When projectile 24 is loaded in barrel 28, barrel 28, projectile 24, and, more specifically, cavity 50 are symmetric, and thus coaxial, about longitudinal axis 38.

Leading end 40 and trailing end 42 are opposite ends of projectile 24 and are stated in reference to a direction of travel or flight 52 of projectile 24. That is, leading end 40 leads trailing end 42 during travel through barrel 28, out of barrel 28, and flight through the air until projectile 24 impacts a target (not shown). Projectile 24 can have a longitudinal length, for example, of six inches.

Head portion 44 includes leading end 40 (which includes the nose of projectile 24), a portion of outer surface 48, and a closed end 60 of cavity 50. Further, head portion 44 has a generally elliptical cross-sectional shape along longitudinal axis 38. Head portion 44 and fin portion 46 provide projectile 24 with a missile-like or torpedo-like appearance. Head 44 can have a two-inch diameter. The nose has a curved shape which allows projectile 24 to hit the target relatively softly, the shape of the nose distributing the impact over a relatively wider area using the relatively soft foam forming projectile 24.

Figure 2:
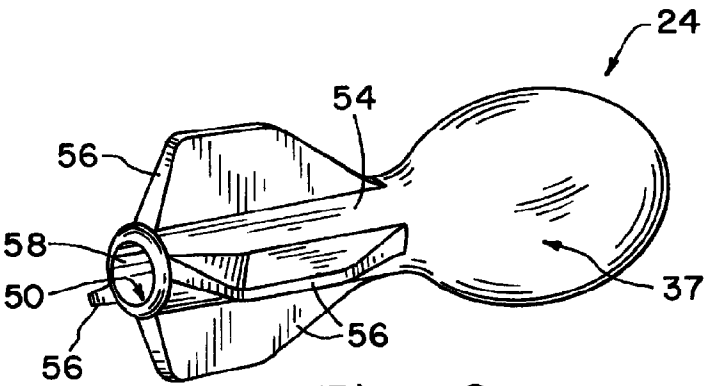
FIG. 2 is a perspective view of the projectile shown in FIG. 1.
Figure 3:
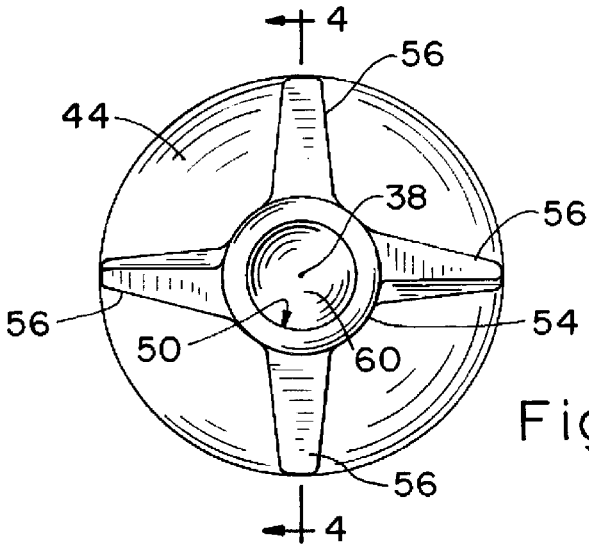
FIG. 3 is a rear elevation view of the projectile of FIG. 2.
Figure 4:
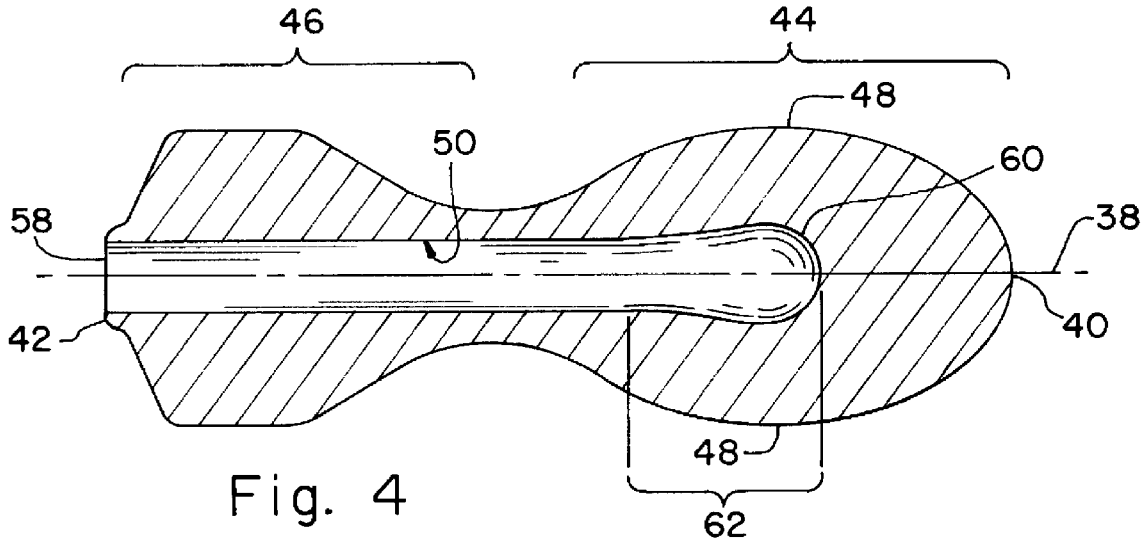
FIG. 4 is a cross-sectional view of the projectile of FIG. 2 taken along line 4-4 in FIG. 3.

Fin portion 46 includes trailing end 42. Further, fin portion 46 includes a stem 54 and a plurality of fins 56 projecting from stem 54. FIGS. 2-3 show fin portion 46 including four fins 56 spaced equidistantly about the circumferential periphery of stem 54. Two fins can be relatively straight, while two fins can be slightly angled (have an offset portion) so as to create a proper spin and thereby to ensure a precise flight path of projectile 24 upon launch. In FIG. 3, the straight fins are shown at the 12 o'clock and 6 o'clock positions, and the angled fins are shown at the 3 o'clock and 9 o'clock positions. The outermost radial extent of fin portion 46 can be substantially the same as, or alternatively a little less than, the outermost radial extent of head portion 44. By way of example, the outermost radial extent of fin portion 46 can be approximately two-inches. Fin portion 46 can include more or less than four fins.

Cavity 50 is configured for expanding when cavity 50 receives propellant 36 from pneumatic launcher 22 and thereby for causing elastic projectile 24 to sealingly engage inside diameter 34 of barrel 28. Cavity 50 is formed out of head portion 44 and fin portion 46 (as well as any neck portion therebetween). Cavity 50 is formed by the elastic foam body 37 of both head and fin portions 44 and 46 and is thus elastic itself and expandable. Cavity 50 is a longitudinally extending blind bore 50 formed in projectile 24 and thus includes an open end 58 and a closed end 60. Open end 58 of cavity 50 is formed in trailing end 42 of projectile 24. Closed end 60 of cavity 50 is formed in the interior of main body portion 44. Closed end 60 can terminate inside main body portion 44 approximately halfway, or a little more, running from the proximal end of head 44 to the distal end of head 44, the proximal end of head 44 being closer to fin portion 46 than the distal end of head 44 (the distal end of head 44 is the leading end 40 of projectile 24). Stated another way, closed end 60 can terminate inside head 44 at approximately the part of head 44 where outer surface 48 of head 44 is the widest (along an axis which is transverse to longitudinal axis 38), or just a little forward (towards leading end 40) of that widest part.

Cavity 50 is symmetric about longitudinal axis 38 of projectile 24. That is, longitudinal axis 38 forms the center point of a cross-section of cavity 50 taken along an axis which is perpendicular to longitudinal axis 38. Longitudinal bore 50 can have a circular cross-section and a constant diameter (as a cylinder) running from open end 58 to a rounded closed end 60 (the rounded closed end forming generally part of a sphere). Such a longitudinal bore is shown, for example, in FIG. 13. Alternatively, and as indicated in FIGS. 3-10, longitudinal bore 50 can have an increased diameter portion 62 which includes closed end 60 and which has a diameter that is larger than the diameter of the portion of longitudinal bore 50 formed in the fin portion 46 of projectile 24. That is, as longitudinal bore 50 runs from open end 58 to closed end 60, bore 50 can have a circular cross-section and a constant diameter (like a cylinder) until, for instance, bore 50 reaches a transition position. The transition position can begin at the proximal end of head portion 44 or, optionally, at a position which is a little forward (towards leading end 40) of the proximal end of head portion 44. When bore 50 reaches the transition position, the diameter of bore 50 can begin to increase gradually (like a cone) until bore 50 reaches closed end 60, which generally forms part of a sphere. As such, all or substantially all of that portion of bore 50 in head portion 44 has a larger diameter than that portion of bore 50 in fin portion 46. As with all portions of cavity 50, increased diameter portion 62 and closed end 60 are elastic and expandable. The shading in FIGS. 2-4 and 9-10 show the contour of cavity 50, but shading of cavity 50 (and cavity 250 in FIG. 13 as well) is omitted in the other figures for purposes of clarity; thus, for instance, while contour shading of cavity 50 is not shown in FIGS. 5-8, it is understood that cavity 50 in FIGS. 5-8 has the same contour as cavity 50 in FIGS. 2-4 and 9-10. Having an increased diameter portion 62 of cavity 50 can be advantageous in facilitating expansion of that portion of cavity 50 in head portion 44 when cavity 50 receives propellant 36 from launcher 22. Further, having an increased diameter portion 62 of cavity 50 can be advantageous in facilitating expansion of closed end 60, and generally that portion of cavity 50 in head portion 44, more than any other portion of cavity 50 when cavity 50 receives propellant 36 from launcher 22.

Closed end 60 of cavity 50 expands when cavity 50 receives propellant 36 from launcher 22. Further, closed end 60 can expand more than any other portion of cavity 50 when cavity 50 receives propellant 36 from launcher 22. Further, outer surface 48 of head portion 44 is pressed against inside diameter 34 of barrel 28 when closed end 60 expands for having received propellant 36 from launcher 22. More specifically, closed end 60 presses radially outwardly towards outer surface 48 of head portion 44 and thereby causes outer surface 48 of head portion 44 to be pressed radially outwardly and to be constrained by inside diameter 34 of barrel 28 so as to inhibit propellant 36 from flowing between outer surface 48 of head portion 44 of foam projectile 24 and inside diameter 34 of barrel 28 when closed end 60 receives propellant 36 from launcher 22.

Figure 5:
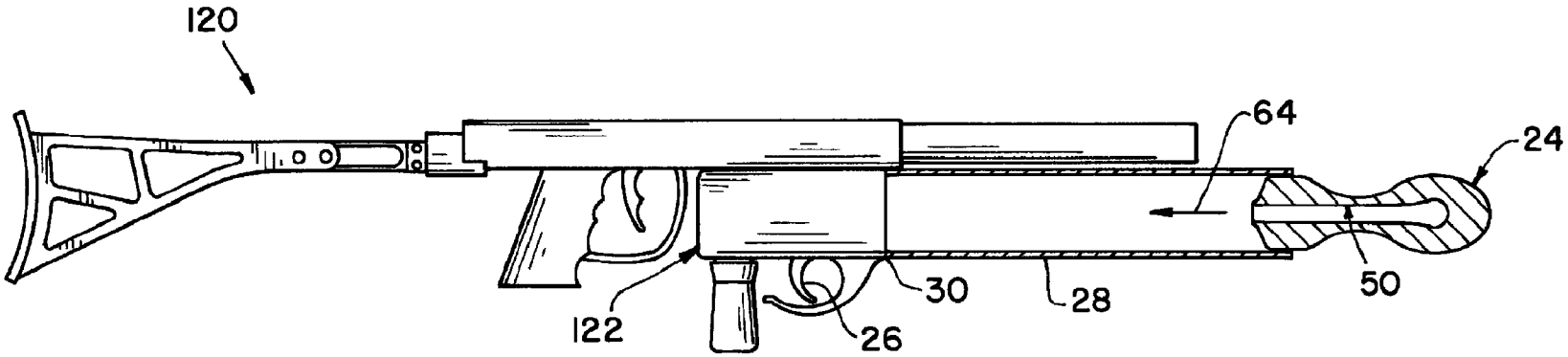
FIG. 5 is a side elevation view of another embodiment of the combat game weapon system of the present invention, the projectile shown as being loaded into the muzzle end (the distal end) of the barrel of the launcher.

Now, additionally referring to FIGS. 5-8, the principle of operation of the present invention is illustrated (again, the same principle of operation applies to system 120 as to system 20). For the sake of clarity, barrel 28 of launcher 122 and projectile 24 are shown in cross-section in FIGS. 5-8. FIG. 5 illustrates the loading of projectile 24 into the muzzle end 32

Figure 6:
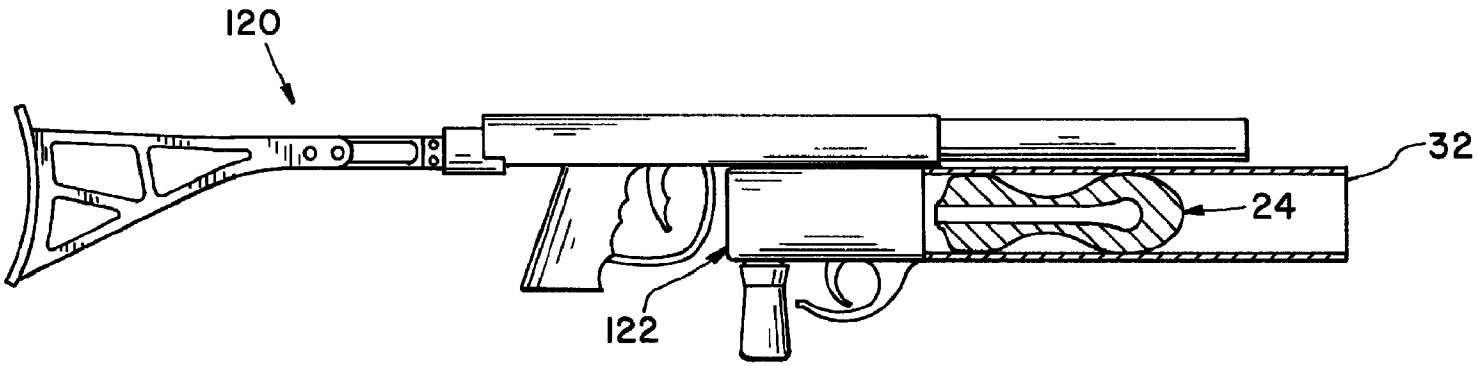
FIG. 6 is a side elevation view of the combat game weapon system of FIG. 5 with the barrel of the launcher and the projectile shown in cross-section as in FIG. 5, the projectile shown at rest after having been loaded in the barrel of the launcher prior to injection of propellant.
Figure 7:
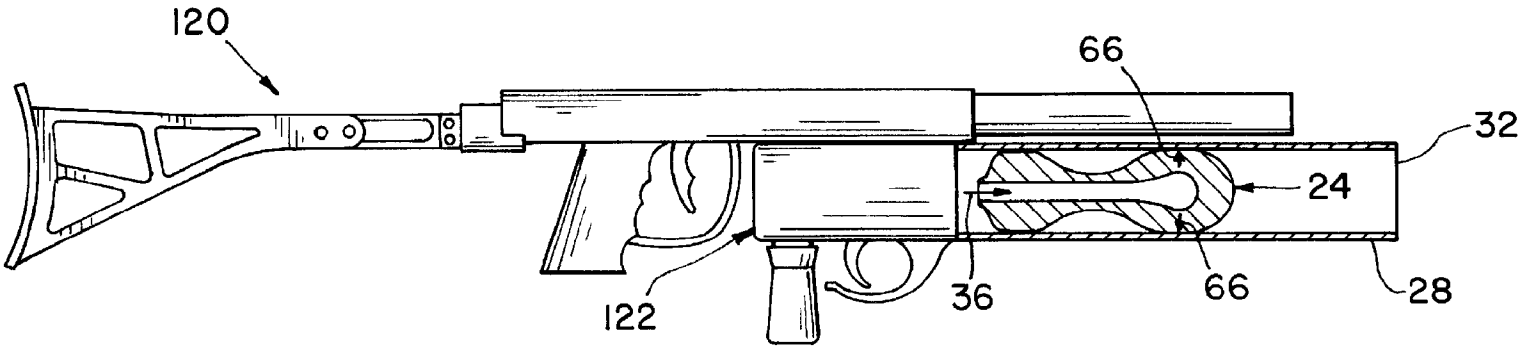
FIG. 7 is a side elevation view of the combat game weapon system of FIG. 5 with the barrel of the launcher and the projectile shown in cross-section as in FIG. 5, the cavity of the projectile shown as receiving propellant from the launcher and the closed end of the cavity shown as expanding due to receipt of propellant.
Figure 8:
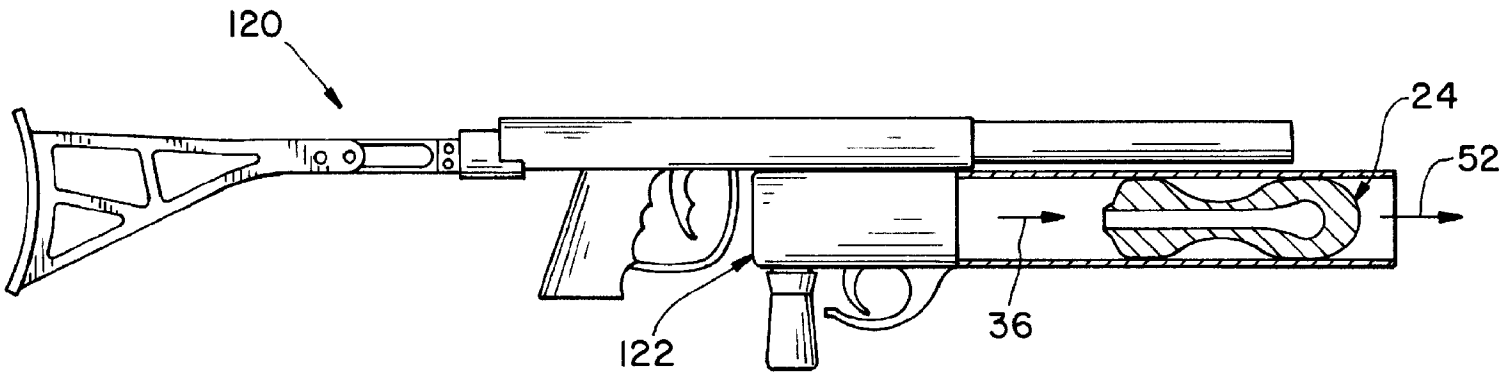
FIG. 8 is a side elevation view of the combat game weapon system of FIG. 5 with the barrel of the launcher and the projectile shown in cross-section as in FIG. 5, the projectile shown as traveling toward the muzzle end of the barrel of the launcher after the cavity received propellant.

(the distal end 32) of launcher 122, arrow 64 indicating direction of loading. FIG. 6 illustrates projectile 24 being at rest just before the firing of launcher 122. FIG. 7 illustrates an initial condition in the firing of launcher 122, wherein an air blast 36 (high pressure air is assumed to be the propellant 36, for example) is introduced proximate to the center of the rear of projectile 24—that is, proximate to trailing end 42 of projectile 24. This allows high pressure air 36 to enter into cavity 50 causing a portion of projectile 24, particularly that portion of cavity 50 associated with increased diameter portion 62 (and thus closed end 60), to expand radially outwardly, as indicated by direction of expansion arrows 66. As closed end 60, for instance, expands, outer surface 48 of head portion 44 expands radially outwardly as well so as to thereby enhance the sealing of projectile 24 against inside diameter 34 of barrel 28. As indicated by FIG. 8, projectile 24 then travels down barrel 28 (in direction of travel 52) and leaves distal end 32 of barrel 28 at a velocity that is enhanced by the sealing of outer surface 48 (what can also be referred to as the outside diameter) of head 44 of projectile 24 against inside diameter 34 of barrel 28. This enhances the velocity of projectile 24, thereby increasing the range to more closely simulate an actual grenade launcher.

Figure 9:
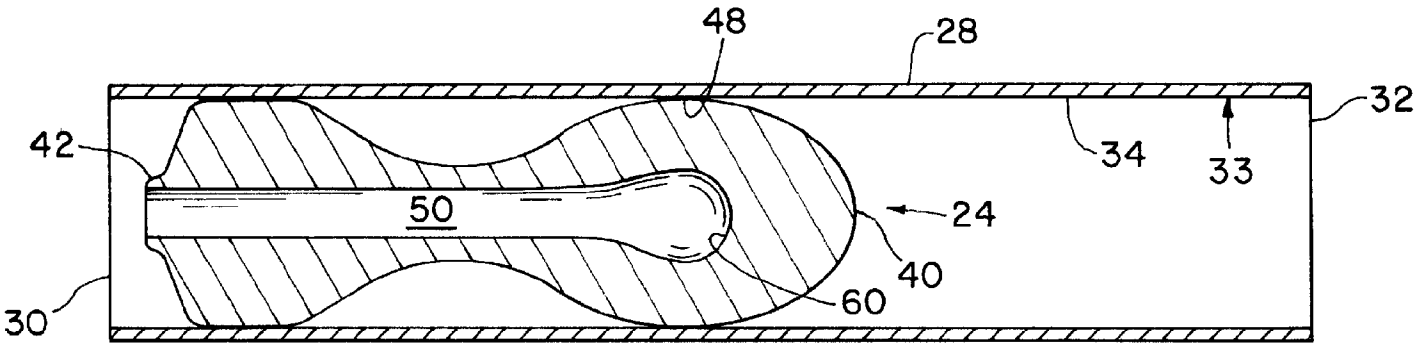
FIG. 9 is a fragmentary, cross-sectional view of the combat game weapon system of FIG. 5, the barrel of the launcher and the projectile shown in cross-section as in FIG. 5, the projectile not yet having received propellant from the launcher.
Figure 10:
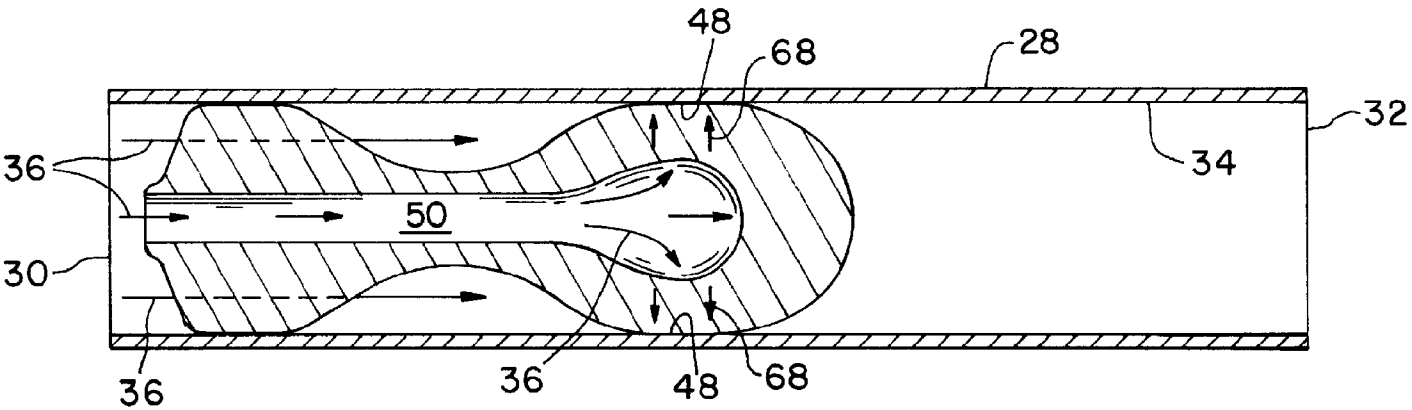
FIG. 10 is a fragmentary, cross-sectional view of the combat game weapon system of FIG. 5, the barrel of the launcher and the projectile shown in cross-section as in FIG. 5, the projectile having received propellant from the launcher.

Now, additionally referring to FIGS. 9 and 10, there is shown a cross-sectional view of foam projectile 24. In FIG. 9, projectile 24 is at rest in barrel 28 proximate to breech end 30 of barrel 28 and pointed toward muzzle end 32 of barrel 28, launcher 122 not having yet introduced the air blast 36 into barrel 28. As illustrated in FIG. 10, the wide portion of head portion 44 expands against inside diameter 34 of barrel 28 (as illustrated with the vertically oriented arrows 68) as closed end 60 expands (the expansion in FIG. 10 of closed end 60 being shown by the greater size of closed end 60 relative to closed end 60 in FIG. 9). The arrows in cavity 50, as well as the horizontally directed arrows outside of cavity 50, in FIG. 10 illustrate the flow of propellant 36 (i.e., compressed gas). The arrows in FIG. 10 outside of cavity 50 are shown as including broken lines; the brokenness of the lines indicates that the flow of propellant 36 travels behind the two fins 56 shown in FIG. 10, considering that the section is taken directly through the middle of the two fins 56 shown in FIG. 10. Closed end 60 of cavity 50 takes on an alternate shape that presses outward, causing outer surface 48 of main body portion 44 of projectile 24 to be pressed outwardly and to be constrained by inside diameter 34 of barrel 28. This advantageously prevents or greatly reduces flow of any propellant 36 (i.e., air) around head 44. This construct additionally places proportionately a greater weight in the forward portion of projectile 24 (the leading portion), thereby enhancing the flight of projectile 24 once it leaves barrel 28.

In use, then, projectile 24 is loaded in barrel 28 of launcher 122 (or launcher 22). Baby powder can be used to facilitate loading of projectile 24 in bore 33. Upon squeezing trigger 26 of launcher 122, propellant 36 (a compressed gas) is injected into barrel 28. Propellant 36 enters cavity 50 and causes closed end 60 (or, more broadly, increased diameter portion 62) of cavity 50 to expand. This expansion occurs, at least primarily, in head portion 44 of projectile 24. This expansion of cavity 50 in closed end 60 causes outer surface 48 of head 44 to expand radially and thereby to sealingly engage inside diameter 34 of barrel 28. This sealing engagement inhibits, completely or at least substantially, propellant 36 from traveling past projectile 24 outside of cavity 50. Thus, projectile 24 is expelled with greater velocity than without such a seal.

Now, additionally referring to FIGS. 11 and 12, there is shown yet another embodiment of the combat game weapon system of the present invention, that system having the reference number 220. System 220 employs launcher 122 but could employ launcher 22 in place of launcher 122. The foam projectile, now labeled as 124, is shown in bore 33 of barrel 28 of launcher 122. FIG. 11 shows only barrel 28 of launcher 122 and projectile 124. The cross-section line in FIGS. 11 and 12 are taken through the 12 o'clock and 6 o'clock positions of both barrel 28 and projectile 124. Projectile 124 is a third embodiment of the projectile according to the present invention. Projectile 124 includes cavity 150. In FIG. 11, projectile 124 has not yet received propellant 36 from launcher 122; stated another way, FIG. 11 shows projectile 124 before firing launcher 122. FIG. 12 shows cavity 150 of projectile 124 having received propellant 36 from launcher 122. FIG. 12 also shows the deformation of the rear end (the trailing end) of foam projectile 124 as propellant 36 (i.e., high pressure air) enters barrel 28 pressing rear portion 148 of projectile 124 against inside diameter 34 of barrel 28 as projectile 124 moves down barrel 28.

Now, additionally referring to FIG. 13, there is shown yet another embodiment of the combat game weapon system of the present invention, that system having the reference number 320. System 320 employs launcher 122 but could employ launcher 22 in place of launcher 122. The foam projectile, now labeled as 224, is positioned partially inside of barrel 28 of launcher 122. FIG. 13 shows only barrel 28 of launcher 122 and projectile 224. The cross-section line in FIG. 13 is taken through the 12 o'clock and 6 o'clock positions of both barrel 28 and projectile 224. Projectile 224 is a fourth embodiment of the projectile according to the present invention and is in the form of a rocket propelled grenade. Projectile 224 includes cavity 250. Projectile 224 has the cross-section of a rocket propelled grenade ("RPG"), with a rear portion (the trailing portion) that works under the principle of operation as discussed above. FIG. 13 shows cavity 250 receiving propellant 36 from launcher 122. Double-arrow 272 shows the direction of expansion of closed end 260 of cavity 250, as well as the direction of expansion of outer surface 248 of projectile 224 in the vicinity of this expansion of closed end 260. While cavity 250 is shown as having a constant diameter, it is understood that cavity 250 could include an increased diameter portion like cavity 50.

The present invention further provides a method for operating a combat game weapon system 20, the method including the steps of providing, loading, receiving, expanding, and expelling. The providing step provides pneumatic launcher 22 including barrel 28, barrel 28 including distal end 32 and bore 33 with inside diameter 34. The loading step loads pneumatic launcher 22 with elastic projectile 24 including cavity 50. The receiving step receives in cavity 50 propellant 36 from pneumatic launcher 22. The expanding step expands cavity 50, when cavity 50 receives propellant 36 from pneumatic launcher 22, and thereby causing elastic projectile 24 to sealingly engage inside diameter 34. The expelling step expels elastic projectile 24 from distal end 32 of barrel 28. Elastic projectile 24 can include leading end 40 and trailing end 42, cavity 50 being a longitudinally extending blind bore 50 in elastic projectile 24 such that cavity 50 includes open end 58 and closed end 60, open end 58 formed in trailing end 42, elastic projectile 24 being a foam projectile 24. The expanding step can include expanding closed end 60 when cavity 50 receives propellant 36 from launcher 22. The expanding step can include expanding closed end 60 more than any other portion of cavity 50 when cavity 50 receives propellant 36 from launcher 22. The method can further include the steps of pressing closed end 60 radially outwardly towards outer surface 48 of elastic projectile 24 and thereby causing outer surface 48 to be pressed radially outwardly and to be constrained by inside diameter 34 so as to inhibit propellant 36 from flowing between outer surface 48 of elastic projectile 24 and inside diameter 34 when closed end 58 receives propellant 36 from launcher 22. Elastic projectile 24 can include fin portion 46 and head portion 44, fin portion 46 including a plurality of fins 56 and trailing end 42 of elastic projectile 24, head portion 44 including leading end 40 of elastic projectile 24, closed end 60 of cavity 50, and outer surface 48, the method further including the step of pressing outer surface 48 against inside diameter 34 when closed end 60 expands for having received propellant 36 from launcher 22.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A combat game weapon system, comprising:

a pneumatic launcher including a barrel, said barrel including a distal end and a bore with an inside diameter; and an elastic projectile configured for being expelled from said distal end of said barrel, said elastic projectile consisting of a forward portion and a rear guidance portion, said forward portion and said rear guidance portion including a cavity that expands when said cavity receives a propellant from said pneumatic launcher and that thereby causes at least one of said forward portion and said rear guidance portion to sealingly engage said inside diameter, said elastic projectile being a monolithic structure.

2. The combat game weapon system of claim 1, wherein said elastic projectile includes a leading end and a trailing end, said cavity being a longitudinally extending blind bore in said elastic projectile such that said cavity includes an open end and a closed end, said open end formed in said trailing end, said elastic projectile being a foam projectile.

3. The combat game weapon system of claim 2, wherein said closed end is configured for expanding when said cavity receives said propellant from said launcher.

4. The combat game weapon system of claim 3, wherein said closed end is configured for expanding more than any other portion of said cavity when said cavity receives said propellant from said launcher.

5. The combat game weapon system of claim 2, wherein said elastic projectile has an outer surface, said closed end being configured for pressing radially outwardly towards said outer surface and thereby causing said outer surface to be pressed radially outwardly and to be constrained by said inside diameter so as to inhibit said propellant from flowing between said outer surface of said elastic projectile and said inside diameter when said closed end receives said propellant from said launcher.

6. The combat game weapon system of claim 2, wherein said rear guidance portion includes a fin portion and said forward portion includes a head portion, said fin portion including a plurality of fins and said trailing end of said elastic projectile, said head portion including said leading end of said elastic projectile, said closed end of said cavity, and an outer surface, said outer surface configured for being pressed against said inside diameter when said closed end expands for having received said propellant from said launcher.

7. A combat game projectile for a combat game weapon system including a pneumatic launcher including a barrel having a distal end and a bore with an inside diameter, said combat game projectile comprising:

an elastic projectile configured for being expelled from the distal end of the barrel of the pneumatic launcher, said elastic projectile consisting of a forward portion and a rear guidance portion, said forward portion and said rear guidance portion including a cavity that expands when said cavity receives a propellant from the pneumatic launcher and that thereby causes at least one of said forward portion and said rear guidance portion to sealingly engage the inside diameter, said elastic projectile being a monolithic structure.

8. The combat game projectile of claim 7, wherein said elastic projectile includes a leading end and a trailing end, said cavity being a longitudinally extending blind bore in said elastic projectile such that said cavity includes an open end and a closed end, said open end formed in said trailing end, said elastic projectile being a foam projectile.

9. The combat game projectile of claim 8, wherein said closed end is configured for expanding when said cavity receives said propellant from the pneumatic launcher.

10. The combat game projectile of claim 9, wherein said closed end is configured for expanding more than any other portion of said cavity when said cavity receives said propellant from the pneumatic launcher.

11. The combat game projectile of claim 8, wherein said elastic projectile has an outer surface, said closed end being configured for pressing radially outwardly towards said outer surface and thereby causing said outer surface to be pressed radially outwardly and to be constrained by the inside diameter so as to inhibit said propellant from flowing between said outer surface of said elastic projectile and the inside diameter when said closed end receives said propellant from the pneumatic launcher.

12. The combat game projectile of claim 8, wherein said rear guidance portion includes a fin portion and said forward portion includes a head portion, said fin portion including a plurality of fins and said trailing end of said elastic projectile, said head portion including said leading end of said elastic projectile, said closed end of said cavity, and an outer surface, said outer surface configured for being pressed against the inside diameter when said closed end expands for having received said propellant from the pneumatic launcher.

13. A method of operating a combat game weapon system, said method comprising the steps of:

providing a pneumatic launcher including a barrel, said barrel including a distal end and a bore with an inside diameter;

loading said pneumatic launcher with an elastic projectile, said elastic projectile consisting of a forward portion and a rear guidance portion, said forward portion and said rear guidance portion including a cavity, said elastic projectile being a monolithic structure;

receiving in said cavity a propellant from said pneumatic launcher;

expanding said cavity, when said cavity receives said propellant from said pneumatic launcher, and thereby causing at least one of said forward portion and said rear guidance portion to sealingly engage said inside diameter; and expelling said elastic projectile from said distal end of said barrel.

14. The method of claim 13, wherein said elastic projectile includes a leading end and a trailing end, said cavity being a longitudinally extending blind bore in said elastic projectile such that said cavity includes an open end and a closed end, said open end formed in said trailing end, said elastic projectile being a foam projectile.

15. The method of claim 14, wherein said expanding step includes expanding said closed end when said cavity receives said propellant from said launcher.

16. The method of claim 15, wherein said expanding step includes expanding said closed end more than any other portion of said cavity when said cavity receives said propellant from said launcher.

17. The method of claim 14, further comprising the steps of pressing said closed end radially outwardly towards an outer surface of said elastic projectile and thereby causing said outer surface to be pressed radially outwardly and to be constrained by said inside diameter so as to inhibit said propellant from flowing between said outer surface of said elastic projectile and said inside diameter when said closed end receives said propellant from said launcher.

18. The method of claim 14, wherein said rear guidance portion includes a fin portion and said forward portion includes a head portion, said fin portion including a plurality of fins and said trailing end of said elastic projectile, said head portion including said leading end of said elastic projectile, said closed end of said cavity, and an outer surface, the method further comprising the step of pressing said outer surface against said inside diameter when said closed end expands for having received said propellant from said launcher.

* * * * *